US005848928A

United States Patent [19]

Wong

[11] Patent Number: 5,848,928

[45] Date of Patent: Dec. 15, 1998

[54] FINGER PUPPET EATING UTENSIL

[76] Inventor: Ken E. Wong, 254 Huali St. #6, Honolulu, Hi. 96813

[21] Appl. No.: 773,926

[22] Filed: Dec. 30, 1996

[51] Int. Cl.[6] ..... A63H 3/14

[52] U.S. Cl. ..... 446/329; 446/73; 446/80; 446/387; 446/488; 294/1.3

[58] Field of Search ..... 446/26, 71, 72, 446/73, 80, 304, 327, 328, 329, 387, 388, 488; 294/1.3, 3, 25, 26.5

[56] References Cited

U.S. PATENT DOCUMENTS

| | | | |
|---|---|---|---|
| 502,896 | 8/1893 | Vine | 446/327 |
| 3,407,927 | 10/1968 | Jones | 294/1.3 |
| 3,848,356 | 11/1974 | Wylie et al. | 446/327 |
| 3,848,906 | 11/1974 | Fleischman | 294/1.3 |
| 3,917,333 | 11/1975 | Grattan | 294/1.3 |
| 4,010,570 | 3/1977 | Kohler | 446/327 |
| 4,173,842 | 11/1979 | Bahner . | |
| 4,188,055 | 2/1980 | Green | 294/1.3 |
| 4,276,715 | 7/1981 | Rogers | 446/329 |
| 4,544,365 | 10/1985 | Donovan | 446/329 |
| 4,555,236 | 11/1985 | Peyton | 446/329 |
| 4,689,828 | 9/1987 | Brewer | 2/21 |
| 4,694,843 | 9/1987 | Casenhiser | 132/73 |
| 4,715,639 | 12/1987 | Nicoletta . | |
| 4,747,633 | 5/1988 | Stacy | 294/1.3 |
| 4,751,747 | 6/1988 | Banks | 2/21 |
| 4,796,302 | 1/1989 | Davis | 2/21 |
| 4,854,624 | 8/1989 | Baymiller | 294/1.3 |
| 4,869,702 | 9/1989 | Derby, III | 446/329 |
| 4,938,515 | 7/1990 | Fazio | 294/25 |
| 5,020,160 | 6/1991 | Cano | 2/159 |
| 5,373,640 | 12/1994 | Cordeiro, Jr. | 30/142 |
| 5,542,125 | 8/1996 | Zuckerwar | 2/158 |
| 5,580,292 | 12/1996 | Gaportsin | 446/304 |

*Primary Examiner*—Robert A. Hafer
*Assistant Examiner*—Jeffrey D. Carlson

[57] ABSTRACT

A simple and inexpensive combination grasping tool and puppet is disclosed in the form of a sheet with distal ends. The tool comprises a single sheet of pliable material with finger-lock 'x' slits that provide a custom locked fit around a user's fingers that have been pushed through the slits, thus freeing the user from the requirement of holding onto the tool. After the user has inserted and locked his index finger and thumb into the 'x' slits, the device then takes advantage of the user's own dexterous use of his finger and hand muscles and joints to open and close the device while picking up small food items. The distal ends of the device that fold around the inserted fingers serve to: 1) provide an outwardly facing printable display area, and 2) provide a continuous protective barrier for the fingers being used from the small food items being grasped. Many materials with surface textures are envisioned for use in making the tool for two reasons: 1) to provide enhanced grip ability of small objects with the puppet, and 2) to enhance the tactile information against the user's finger tips areas as they are locked inside the folded, distal ends. As the tool is worn and manipulated between the thumb and index finger, strategic placement of artwork or other indicia exemplifying a face upon the surface of the sheet then causes the device to appear to be an articulate puppet which can open and close its mouth.

5 Claims, 1 Drawing Sheet

FINGER PUPPET EATING UTENSIL

FIELD OF INVENTION

The present invention relates to devices used to pick up and grab small objects during the act of consuming food. More specifically, this invention relates to a disposable grasping utensil that can be stored flat and then worn by a user while grabbing and picking up said objects. The resulting invention as it is worn by a user prevents direct skin contact between said objects and the user's fingers and hands. The appearance of the invention, while being worn by the user, also allows the distal ends of the device to be manipulated by the user so as to create the illusion of an articulating structure which can be further enhanced by artwork or other indicia to create a puppet that appears to open and close at its mouth.

BACKGROUND ART

This device relates to grasping devices, puppets, and protective finger coverings. A search for awarded patents in these areas did not reveal inventions that addressed the unique novel characteristics and requirements of the puppet which serves as a grasping device, puppet, and protective finger covering all contained in one device.

It is an objective of the puppet to allow the user, as the device is applied and worn on the user's fingers, to utilize the muscles and joints of the finger and hand to provide the hinge movement by which the device is opened and closed. It is further the objective of the invention to utilize the user's own natural finger and hand dexterity, as the device is being worn, when grasping small objects thus improving the user's ability to grasp said objects.

It is also an objective of the puppet to protect the fingers of the user from contact with small food objects as they being grasped with the device as it is worn by the user.

It is also an objective of the puppet to form an unusually entertaining novelty device which may carry artwork or other indicia exemplifying a face and, which can be articulated as it is applied and worn on a user's thumb and index finger to create a puppet that appears to open and close at its mouth.

It is another objective of the puppet to form a grasping tool from a substantially flat sheet of pressed paper which, furthermore, can be applied and worn on the user's thumb and index finger without significant handling or operations of assembly, thus reducing the number of steps involved in making the device ready for use by the ultimate consumer.

SUMMARY OF THE INVENTION

The invented grasping device is designed for use as a protective finger covering which allows a user to grasp small objects and, which, also becomes an entertaining novelty device which may carry artwork or other indicia exemplifying a face which can be articulated as the device is applied and worn on a user's fingers, thus creating create a puppet that appears to open and close at its mouth.

The invented grasping device is formed from a single rectangular-shaped piece of flat material, preferably pressed paper pulp, although other materials may include plastics, rubbers, or a combination there of. The sheet is formed to have a length defined by a first end and a second end. Two pairs of slits are made in the sheet, on both the first and second ends, each in the configuration of an 'x', the 'x' slit located on one end being slightly larger than the 'x' slit on the opposite end. Preferably, the end with the end with the smaller 'x' slit serves as the index finger end and the other of the device with the larger 'x' slit serves as the thumb end. A protective finger covering device can then be made as the ends of the device are then folded towards its center. The user then inserts his index finger through the 'x' slit in the index finger end and his thumb through the 'x' slit in the thumb end of the device which have now been folded over. A continuous protective covering is thus created for the finger and thumb as the single piece of material then folds over and around the finger and thumb tips that have been inserted through the 'x' slits. Once the user's finger and thumb have been inserted into the 'x' slits, they become 'locked' into the device as the flaps created by the 'x' slits are pushed toward the tips of the finger and thumb and then create a slight resistance against the surface of the finger and thumb if they are withdrawn from the device. A custom fit around the user's fingers is created by 1) the amount of opening by the flaps and resulting resistance against the user's fingers and 2) the enlargement of the 'x' slits made possible by the tearing of the material where the diameter of the user's finger or thumb is greater than the length of each slit The ability of the 'x' slit to tear, and therefore become larger, is made possible if the structure is comprised of a tearable paper pulp. The ability of the 'x' slit to stretch, and therefore become larger, is also made possible if the structure is comprised of a material such as rubber.

The sheet can be comprised of various light, flexible and pliable materials further covered by a texture(s) to increase grip ability of small objects and enhance the tactile characteristics against the user's finger and thumb tips especially in the user's fingerprint areas. In one embodiment, the texture may include multiple nubbins and depressions interspersed about the sheet, preferably in a uniform repeating geometrical pattern. The "puppet's face" can additionally be enhanced in cases where materials may allow the face to 'rise' out of the device's surface, further enhancing the invention's entertainment value.

LIST OF REFERENCE NUMERALS

Figure 1:
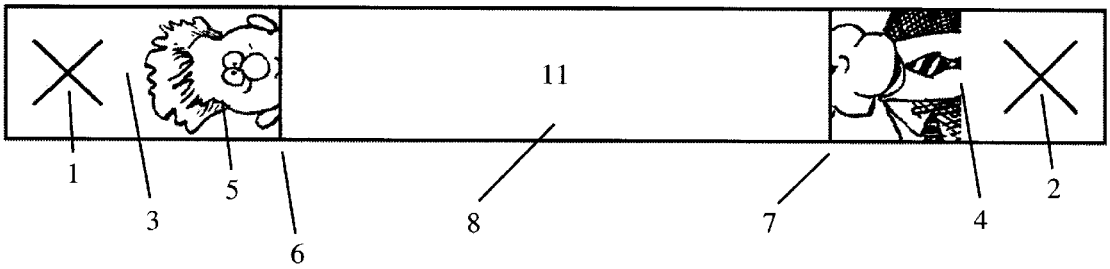
FIG. 1 is a top plain view of the puppet of the present invention, shown unfolded.

1. Finger lock 'x' slit
2. Thumb lock 'x' slit
3. Index finger end (of sheet)
4. Thumb end (of sheet)
5. Puppet face artwork
6. Fold line (index finger end)
7. Fold line (thumb end)
8. Center (of sheet)
9. Finger lock flap
10. Food object
11. Sheet

DETAILED DESCRIPTION AND BEST MODE OF CARRYING OUT THE INVENTION

Referring to FIG. 1, the puppet is shown in the form of a sheet 11, also described as an elongated square having distal ends. The simple one-piece design of sheet 11 minimizes production costs and steps. A finger lock 'x' slit 1 is located on the index finger end 3 of sheet 11. A thumb lock 'x' slit 2 is located on the thumb end 4 of sheet 11.

Figure 2:
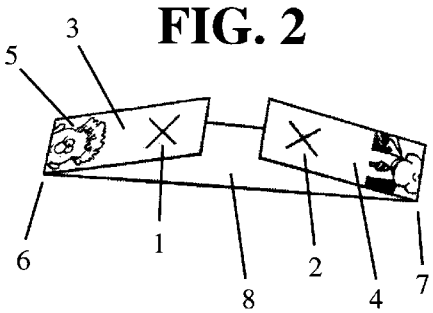
FIG. 2 is a perspective view of a folded puppet before it has been applied to a user's index finger and thumb.

As shown in FIG. 2, when sheet 11 is configured as described above, a puppet can then be assembled by folding index finger end 3 at fold line 6 toward the center 8 of sheet 11 and then folding thumb end 4 at fold line 7 of sheet 11 also toward the center 8 of sheet 11.

Figure 3:
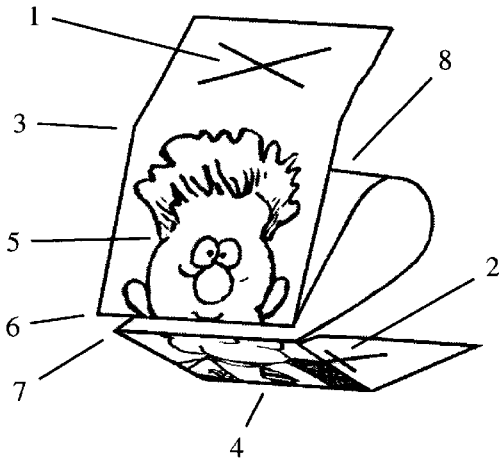
FIG. 3 is a perspective view of a folded puppet showing an application of artistic artwork, after it has been formed in accordance with a index finger and thumb and then removed.

As shown in FIG. 3, a novel feature of the pupu puppet may be the placement of funny faces on the device's surface to give the device a comical appearance. The device's marketability is further enhanced by the possibility of printing company promotional and or advertising information such as in the center 8 of sheet 11 (FIG. 1). As the device is applied and worn on a user's index finger and thumb (FIG. 4), movements by the user of the index finger and thumb cause articulation of the puppet in center 8 of sheet 11, thereby creating the appearance that the puppet is capable of opening and closing its mouth.

Figure 4:
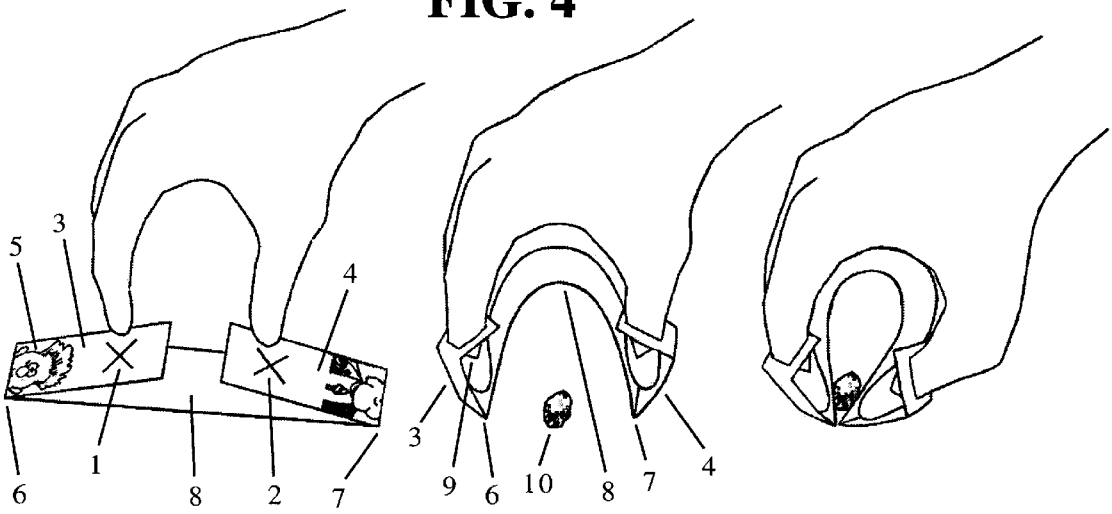
FIG. 4 is a perspective view of the puppet of the present invention as a user's index finger and thumb are first inserted into the device, and then used to articulate the device during the act of grasping a small object.

As shown in FIG. 4, the user applies the puppet to his index finger and thumb by inserting his index finger into finger lock 'x' slit 1 and his thumb into thumb lock 'x' slit 2. Once the user's index finger and thumb have been pushed into the fingers lock 'x' slits 1 and 2, finger lock flaps 9 are created. These finger lock flaps 9 serve to lock and hold the device onto the finger and thumb and, provide resistance against the skin of the finger and thumb which keeps them from pulling out of 'x' slits 1 and 2. This 'lock' effect, however, is not dramatic enough to create a significant obstacle and still allows the user to remove his index finger and thumb from the device. A unique aspect of the finger lock 'x' slits 1 and 2 is that they allow the index finger and thumb to tear sheet 11 beyond the end of the slits if the diameter of the user's corresponding index finger and thumb is greater then the length of slits, thereby enlarging finger lock 'x' slits 1 and 2 to create a custom fit around the user's index finger and thumb. The finger lock 'x' slits 1 and 2 allow the puppet to lock onto the user's index finger and thumb and be worn much like a glove, thus freeing the user of the additional responsibility of holding onto the device. Because the puppet is applied and worn on the user's index finger and thumb, the puppet as a grasping tool uniquely utilizes the user's own natural finger and hand muscles and joints while picking up food object 10. Grasping ability occurs as the user's index finger and thumb, inserted accordingly into index finger end 3 of sheet 11 and thumb end 4 of sheet 11, can then be opened and closed around food object 10 in the same manner as if the user were using his own naked index finger and thumb. The lack of any resiliency in the center 8 of sheet 11 enables the user to comfortably open and close the device as it offers no resistance and requires no finger or hand pressure by the user. The lack of required pressure and simultaneous maneuvering by the user of the puppet enhances the act of reaching for and picking up food object 10, thereby allowing the user to take greater advantage of his own finger and hand dexterity. The device, therefore, is effortless to use and is controlled solely by the user's own finger and hand muscles. In addition, the resulting configuration of the puppet as it is being worn on the index finger and thumb is small in size and because it allows greater use of the user's own finger and hand dexterity, the user is then able to reach into confined areas such as a potato chip bag or cookie box to retrieve small food objects. Index finger end 3 of sheet 11 and thumb end 4 of sheet 11 serve to protect the finger and thumb from contact with food object 10 as they fold around the finger tips without a break in the surface through which food may reach the fingers. The center 8 of sheet 11 is then pushed back toward the hand thereby creating the 'mouth' of the puppet. As the device is applied and worn on a user's fingers, movements by the user of the index finger and thumb cause articulation of the puppet in center 8 of sheet 11, thereby creating the appearance that the puppet is capable of opening and closing its mouth (FIG. 3). In addition, center 8 of sheet 11 connects index finger end 3 with thumb end 4 serve to provide additional protection for the area of hand between the index finger and thumb from potential contact with food object 10.

Alternatively, the puppet can be made wider in the index finger end 3 to accommodate two or more fingers, thereby creating a larger surface area with which to grasp food object 10. A corresponding number of finger lock 'x' slits 1 could then be included on index finger end 3 of sheet 11 for each finger. Due to the variation in sizes of fingers and hands of both children and adults, variations in sizes are envisioned for sheet 11 with correspondingly larger or smaller finger lock 'x' slits 1 and thumb lock 'x' slits 2. More specifically, sizes may include childrens sizes: small, medium, large, and adult sizes: small, medium, large, and extra large.

Many materials are envisioned for use in making sheet 11, however, pressed paper pulp is preferred. Pressed pulp, similar in properties to that use to make semi-rigid paper products such as egg cartons, is pleasing to the touch, partially absorbent, easily formed and relatively inexpensive. Pressed pulp is also desirable for two reasons: 1) to create a 'tear' factor for the finger-lock slits as a user's fingers are inserted into it, and 2) to create a product which is biodegradable and environmentally friendly. Plastics and rubbers may also be substituted, both have which desirable and undesirable inherent qualities. While both materials are non-biodegradable, the irresistance to destruction may be desirable where more permanent versions of the puppet are desired. In addition, the ability to form these materials would make it possible for greater manipulation of the surface area of sheet 11 which could then display three-dimensional artistic information and indicia. Selected materials for sheet 11 would additionally consider surface textures to provide enhanced grip ability for two reasons: 1) to enhance the user's ability to grasp small objects with the puppet, and 2)to enhance the tactile information against the user's fingertips areas as they are locked inside the folded, distal ends of sheet 11 (FIG. 4).

The puppet prevents direct contact between the fingers and, the food being eaten and is applicable in any situation where foods are normally eaten with one's fingers. The device takes advantage of the user's own natural finger and hand dexterity involving the joints and muscles used in picking up small objects. Putting on and removing the device is easily accomplished due to the finger-lock slits located on each end of the one-piece sheet. The simple one-piece design also minimizes production costs and steps. While a preferred embodiment of the invented grasping device and puppet combination has been disclosed, changes and modifications can be made without departing from the spirit of the invention.

What is claimed is:

1. A grasping and puppet combination comprising:

a single, one-layer sheet of elongated material with two ends and a central panel;

a fold line located near each of said ends;

a caricature facial image located outwardly adjacent to at least one of said fold lines;

two sets of intersecting slits located between each end and each respective fold line;

the intersecting slits allowing a finger and a thumb to be inserted therethrough and;

the central panel serving as a structural hinge and being in a curved orientation, the fold lines defining top and bottom edges of a structural mouth which may be opened and closed by manual actuation.

2. The grasping and puppet combination of claim 1 wherein said folded sheet provides an outer protective surface and an opposite inner protected surface.

3. The grasping and puppet combination of claim 1 wherein said intersecting slits are comprised of flaps on the sides of said slits which serve as a resistance removal means for objects inserted into and through said slits.

4. The grasping and puppet combination of claim 1 wherein said intersecting slits are capable of tearing and lengthening to accommodate the size of an object inserted therethrough.

5. The grasping and puppet combination of claim 1 wherein said sheet facilitates conversion between an operational configuration and a flattened storage configuration.

* * * * *